US005085258A

United States Patent [19]

Fink, Jr. et al.

[11] Patent Number: 5,085,258

[45] Date of Patent: Feb. 4, 1992

[54] FUEL DISPENSING NOZZLE IMPROVEMENT

[75] Inventors: Arthur C. Fink, Jr., Lonedell; Thomas O. Mitchell, Maryland Heights, both of Mo.

[73] Assignee: Husky Corporation, Pacific, Mo.

[21] Appl. No.: 587,076

[22] Filed: Sep. 24, 1990

[51] Int. Cl.[5] ..... B65B 3/18; B65B 57/14; B65B 31/06

[52] U.S. Cl. ..... 141/207; 141/208; 141/206

[58] Field of Search ..... 141/206–229, 141/392

[56] References Cited

U.S. PATENT DOCUMENTS

| | | | |
|---|---|---|---|
| 2,343,903 | 3/1944 | Hammand | 141/209 |
| 2,354,209 | 7/1944 | Hammand | 141/209 |
| 2,906,301 | 9/1959 | Mannon | 141/209 |
| 3,502,121 | 3/1970 | Moore et al. | 141/207 |
| 3,710,831 | 1/1973 | Riegel | 141/207 |
| 3,835,899 | 9/1974 | Holder, Jr. | 141/214 |
| 3,982,571 | 9/1976 | Fenton et al. | 141/225 |
| 4,031,930 | 6/1977 | Sutcliffe et al. | 141/207 |
| 4,033,389 | 7/1977 | Hansel et al. | 141/207 |
| 4,121,635 | 10/1978 | Hansel | 141/207 |
| 4,196,759 | 4/1980 | McMath et al. | 141/98 |
| 4,235,266 | 11/1980 | McMath | 141/285 |
| 4,497,350 | 2/1985 | Guertin | 141/206 |
| 4,649,969 | 3/1987 | McMath | 141/290 |
| 4,697,624 | 10/1987 | Bower et al. | 141/208 |
| 4,971,121 | 11/1990 | Guertin | 141/392 |

*Primary Examiner*—Henry J. Recla
*Assistant Examiner*—Casey Jacyna
*Attorney, Agent, or Firm*—Paul M. Denk

[57] ABSTRACT

A fuel dispensing nozzle (10) has a body (12) in which a fuel passage is formed. A spout assembly (18) is attachable to the body in fluid communication therewith for fuel to flow from the body through the spout and into a tank (T). A valve (20) is interposed in the passage and controls fuel flow through the body. A flexible bellows (80) fits over the spout with the outer end (72) thereof sealingly engaging an inlet (I) of the tank to prevent fuel vapors from escaping into the atmosphere. A control apparatus is responsive to movement of the bellows when the spout is inserted into the tank to open the valve, and to removal of the spout from the tank to close the valve. An apparatus (176) is responsive to the vapor pressure within the tank to effect closing of the valve when an overpressure condition occurs thereby to prevent vapor from escaping into the atmosphere. The apparatus includes first and second pivotally connected levers (132, 136) one of which moves in response to movement of the bellows and the other of which moves in response to the vapor pressure reaching a predetermined level indicative of the tank being substantially full to close the valve and prevent vapors from escaping.

13 Claims, 3 Drawing Sheets

FUEL DISPENSING NOZZLE IMPROVEMENT

BACKGROUND OF THE INVENTION

This invention relates to fuel dispensing nozzles of the type used to dispense gasoline for automobiles and the like, and more particularly, to an improvement to such a nozzle assembly to a low dispensing of fuel only when the nozzle is inserted into the inlet of a tank or container and to shut-off dispensing of fuel when the nozzle is removed or when an overpressure condition is sensed within the container.

As is well-known, gasoline dispensing nozzles of the type found in most service stations employ a spout which is inserted into the inlet of the filler pipe of an automobile's fuel tank. The size of the spout, and, in particular, its diameter is smaller than the diameter of the filler pipe. As a result, when the gas cap was removed from the filler pipe and the spout end of the nozzle inserted, there was typically substantial clearance between the side of the spout and the filler pipe. As a consequence, fuel vapors were allowed to escape from the tank into the atmosphere. Because of environmental concerns, it is now a requirement in many locales that fuel dispensing nozzles be equipped so this does not occur. One way utilized to meet these requirements is to provide the nozzle with a flexible bellows assembly which fits over the spout. The bellows is circular in cross-section with a diameter corresponding to the outer diameter of the filler pipe. Now, when the nozzle is inserted into the pipe, the end of the bellows fits snugly against the mouth of the pipe so that the only opening for gasoline vapors to escape is through a vapor passage in the nozzle.

In addition to the above, it is also desirable to prevent dispensing of fuel through a nozzle unless the spout is inserted into the tank. This is done to prevent accidental spillage which not only releases fuel vapors into the atmosphere, but also creates a potentially dangerous fire hazard. The addition of bellows on the nozzle has complicated this problem, and various schemes have been employed to insure pumping occurs only at the proper time. See, for example, U.S. Pat. Nos. 4,031,930 and No. 4,016,910, which are assigned to the same assignee as the present application, as well as U.S. Pat. No. 4,133,355 and No. 4,130,148. While each of the various systems shown in these patents work for their intended purpose, there is still a need for a simple, reliable system which prevents dispensing of fuel through a nozzle unless it is inserted in the filler pipe of a fuel tank with the bellows properly sealing against escape of vapor to the atmosphere.

SUMMARY OF THE INVENTION

Among the several objects of the present invention may be noted the provision of an improvement in a fuel dispensing nozzle; the provision of such an improvement incorporating a bellows assembly and vapor return path to prevent escape of fuel vapors during a dispensing operation; the provision of such an improvement which is responsive to the vapor pressure within a container being filled to automatically shut-off fuel flow through the nozzle when an overpressure condition is sensed which is indicative of the vapor return path being restricted; the provision of such an improvement which quickly and efficiently shuts-off fuel flow so there is no overfilling of the container and a consequent fuel spillage; the provision of such an improvement which prevents dispensing of full through the nozzle unless the spout is inserted into the tank, and, the provision of such an improvement which is readily incorporated in the nozzle and does not interfere with normal operation of the nozzle to dispense fuel.

In accordance with the invention, generally stated, a fuel dispensing nozzle has a body including a fuel passage for fuel to flow from a source thereof through the body. A spout is attached to the body in fluid communication therewith for fuel to flow into the spout from the passage. The distal end of the spout forms a mouth insertable into the tank. A valve is interposed in the passage and controls fuel flow through the body. A flexible bellows fits over the spout and the outer end thereof sealingly engages the inlet of the tank to prevent fuel vapors from escaping into the atmosphere. Operation of the valve controls fuel flow through the nozzle. The valve is openable in response to movement of the bellows when the spout is inserted into the tank. Removal of the spout from the tank causes the valve to close. Vapor pressure within the tank effects closing of the valve when an overpressure condition occurs. This prevents fuel spillage. First and second levers are pivotally connected. One of the levers moves in response to movement of the bellows and the other lever moves in response to the vapor pressure reaching a predetermined level indicative of the tank being substantially full, to close the valve and prevent fuel spillage. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figures 1, 8:
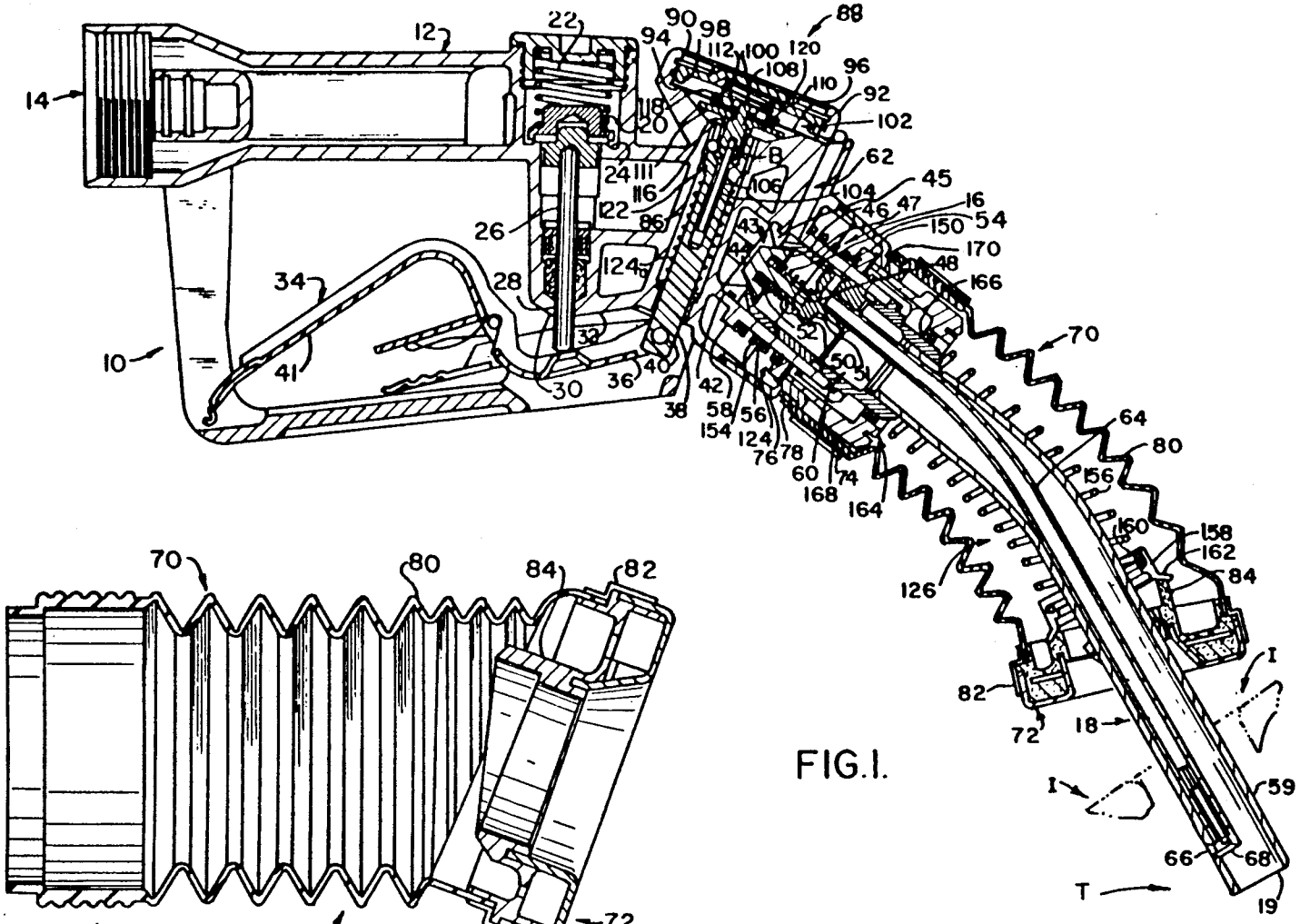
FIG. 1 is a sectional view of a nozzle assembly embodying the improvement of the present invention.

Referring to the drawings, a nozzle for dispensing liquids such as gasoline, diesel fuel or the like is indicated generally at 10. The nozzle includes a body 12 having an inlet 14 to which a fuel hose (not shown) is connected. The nozzle also has an outlet 16 communicating with a spout 18 assembly. Assembly 18 has a mouth 19 insertable into the inlet I of a container such as fuel tank T into which the liquid is to be dispensed. Disposed within body 12, between the inlet and outlet, is a valve 20. This valve is biased by a spring 22 into sealing engagement with a valve seat 24. Valve 20 is secured to the upper end of a valve stem 26. The valve is located in the upper portion of body 12, as seen in FIG. 1, and the valve stem extends downwardly through the body. The lower end of the stem projects through an opening 28 in the base 30 of a body section 32. An operating lever 34 for the nozzle has one end 36, its fulcrum end, connected to the lower end of a plunger 38 by, for example, a pin 40. The outer end 41 of the lever is grasped by the hand of a user, and when squeezed, the upward pressure on the lever, as viewed in FIG. 1, forces valve stem 26 upwardly. This moves valve 20 off valve seat 24, opening the valve, and permitting flow through the nozzle.

Adjacent outlet 16 of the nozzle, in the flow path through body 12, is a venturi section 42. A spring loaded check valve 43 is positioned in the venturi, on the downstream side thereof, so to control fuel flow into the outlet. The check valve has a valve body 44 which is frustoconically shaped and fits into the flow restriction formed by the venturi section. Extending from the underside 46 of the valve body is a valve stem 48. This stem is slidingly received in a cylindrically shaped valve guide 50 which projects inwardly into the outlet from an interior wall portion 51 of the spout assembly. An annular groove 52 is formed in underside 46 of the valve body, adjacent stem 48, and extends upwardly into the valve body. The width of this groove is sufficient for a spring 54 to both fit into the groove and seat against the base thereof. Spring 54 also seats against the base of guide 50. When valve 20 is opened, the rush of fuel through the nozzle body unseats the check valve so fuel can flow through the venturi section to the nozzle outlet. This flow rate is a function of the extent to which valve 43 is pushed downstream against the force of spring 54.

Venturi section 42 is installed in a circular housing 56 which defines outlet 16. An annular shoulder 58 is formed at the inner end of this housing. Spout assembly 18 includes a spout 59 having an inlet end 60 communicating with outlet 16. From its inlet end to its mouth, the spout gradually curves along its length so to facilitate insertion of the spout into inlet I of the tank. An air passage 62 is formed within the nozzle body and communicates with the inner end of a vent tube 64 which fits in the spout. The vent tube is of a smaller diameter than spout 59 for the vent tube to fit within the spout. The length of the vent tube is less than that of the spout for the vent tube to terminate short of the mouth of the spout. An opening or air hole 66 is formed at the outer end of the spout adjacent its mouth. The outer end 68 of the vent tube is a plug to stop air from entering into the vent tub 64.

As shown in FIGS. 1 and 8, a bellows assembly 70 fits over the spout assembly. The bellows assembly is designed for use with the nozzle to help prevent fuel vapors from escaping into the atmosphere when gasoline or a similar fuel is being dispensed into the tank. A detailed description of a bellows assembly such as assembly 70 may be found in U.S. Pat. Nos. 4,031,930 and 4,016,910, which are assigned to the same assignee as the present application. It will be understood, however, that assembly 70 has an outer seal end 72 which abuts against the periphery of the tank inlet to sealingly fit thereagainst. The inner end of the assembly comprises a hollow fitting 74 which is captured on a bellows mounts 76. Mount 76 is a hollow sleeve having a large diameter end which fits over housing 56 and onto the nozzle. The mount has a smaller diameter outer end sized to accommodate the inner end of fitting 74. A clamp 78 (such as an Oetiker clamp) is used to clamp fitting 74 to the bellows mount to hold the bellows assembly in its installed position. A vapor bellows 80 is integrally formed with the fitting. The bellows can vary in length depending upon the particular application of nozzle 10; however, the function of the bellows is always to entrap fuel vapors which escape from the tank when the spout is inserted in the inlet. The outer end of the bellows is attached to the outer seal end of the assembly by, for example, a shrink wrap material 82 which extends about the circumference of the bellows. When installed, the bellows sealingly fits about a vapor boot adapter 84 of the assembly.

Figure 6:
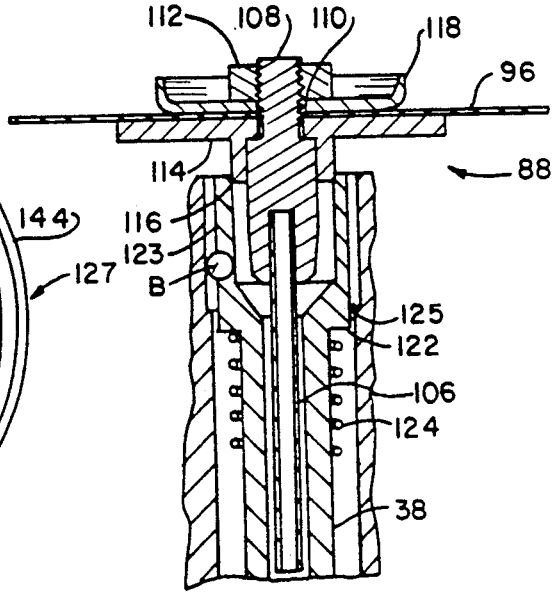
FIG. 6 is a sectional view of a diaphragm assembly installed within the nozzle.
Figure 5:
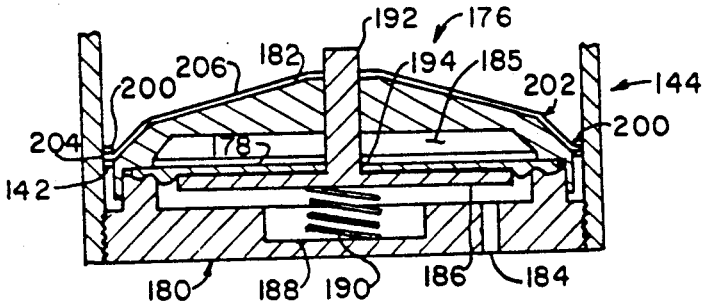
FIG. 5 is a sectional view of another portion of the overpressure assembly.

When tank T is substantially full, it is desirable to terminate fuel flow through the nozzle so to not overfill the tank. For this purpose, plunger 38 extends upwardly through a circular cavity 86 in body 12. While the lower end of the plunger is attached to lever 34, the upper end of the plunger is attached to a diaphragm assembly 88 (see FIG. 6). An opening 90 is formed in upper face 92 of the nozzle body (as viewed in FIG. 1) and a circumferential shoulder 94 extends thereabout. The outer margin of a circular diaphragm 96 is captured between this shoulder and the base 98 of a cap 100 which is retained in the opening. The diaphragm and cap together define a chamber 102. One end of air passage 62, as shown in FIG. 1, opens into this chamber. Plunger 38 has a longitudinal, central bore 104 extending from the upper end thereof partially along its length. Fitting in this bore is a stem 106. Attached to the upper end of the stem is a latch pin assembly 108. Diaphragm 96 has a central opening 110 through which the upper end of the latch pin assembly extends. A nut 112 fits onto this end of the hub to capture the diaphragm on the latch pin assembly. On the underside of the diaphragm is a circular backing plate 114 having an annular flange 116 which fits over the hub assembly. A second backing plate 118 fits on the other side of the diaphragm between the nut and the diaphragm. Backing plate 118 also acts as a seat for a bias spring 120, the other end of which seats against the upper inner face of cap 100. The force of spring 120 urges the latch pin assembly downwardly, via the diaphragm assembly. The plunger has a shoulder 122 (see FIGS. 1 and 6) formed in its outer wall, at the upper end of the plunger. Three equally spaced apart openings or slots 123 (only one of which is shown in FIG. 6) are formed in the upper end of plunger 38. These slots extend from the upper end of the plunger downwardly to a joint above shoulder 122. A ball B is fitted in each slot, the balls being retained by the wall defining cavity 86 and by the latch pin assembly 108.

A spring 124*a* seats against shoulder 122, and the bottom wall of cavity 86 to urge plunger 38 upwardly. Fitting between the plunger and the sidewall of the cavity, at a point immediately above the shoulder is a latch ring 125. The upper surface of the latch ring is conical in shape. When lever 34 is grasped by the user of the nozzle, plunger 38 is held in place by the balls B. This is because the balls are pushed outwardly by the latch pin assembly and latch ring against the sidewall of cavity 86. As a consequence, lever 34 pivots about lever pin 40. The force exerted by the user on the lever is sufficient to overcome the force of spring 22 so the outer end of the lever, gripped by the user, is pulled upwardly (as viewed in FIG. 1), this movement also serving to open valve 20.

As noted, air passage 62 is formed internally of body 12 and communication with vent tube 64. When the nozzle is being used to pump fuel, the fuel flowing past check valve 44 generates a vacuum in a chamber 45 formed by seat 42 and venturi 47. As seen in FIG. 1, chamber 45 communicates with both opening 66 and chamber 102. Air flowing into opening 66 at the mouth end of spout 59 is directed through vent tube 64 and the air passage into chamber 102. Since the chamber is exposed to substantially atmospheric pressure, spring 120 maintains latch pin 108 full extended. This, in turn, keeps valve 20 open. As tank T fills, the level of fuel in the tank rises, eventually reaching opening 66, thus restricting opening 66 and causing an increase in volume pressure in chamber 102. When the vacuum becomes sufficiently strong, the vacuum force overcomes the effect of spring 120 and the latch pin assembly is drawn upwardly. This allows plunger 38 to now move downwardly. Spring 22 then pushes valve 20 against its seat to stop fuel flow through the nozzle. When lever 34 is released, spring 124 urges plunger 38 upwardly. The force of this spring is sufficient to overcome the force of spring 120. This allows balls B to raise past latch ring 125 with latch pin 108 being fully extended into plunger 38. In addition to stopping or preventing fuel flow through the nozzle in these circumstances, there are other times when fuel flow through the nozzle should be prevented. For example, it is also desirable to prevent dispensing of fuel through the nozzle unless the spout is inserted in the tank. By doing so, accidental spills are prevented which would not only release fuel vapors into the atmosphere, but also create a potentially dangerous fire hazard. An improvement of the present invention includes means 127 for preventing fuel flow unless the spout end of the nozzle is inserted in the tank inlet.

Figure 2:
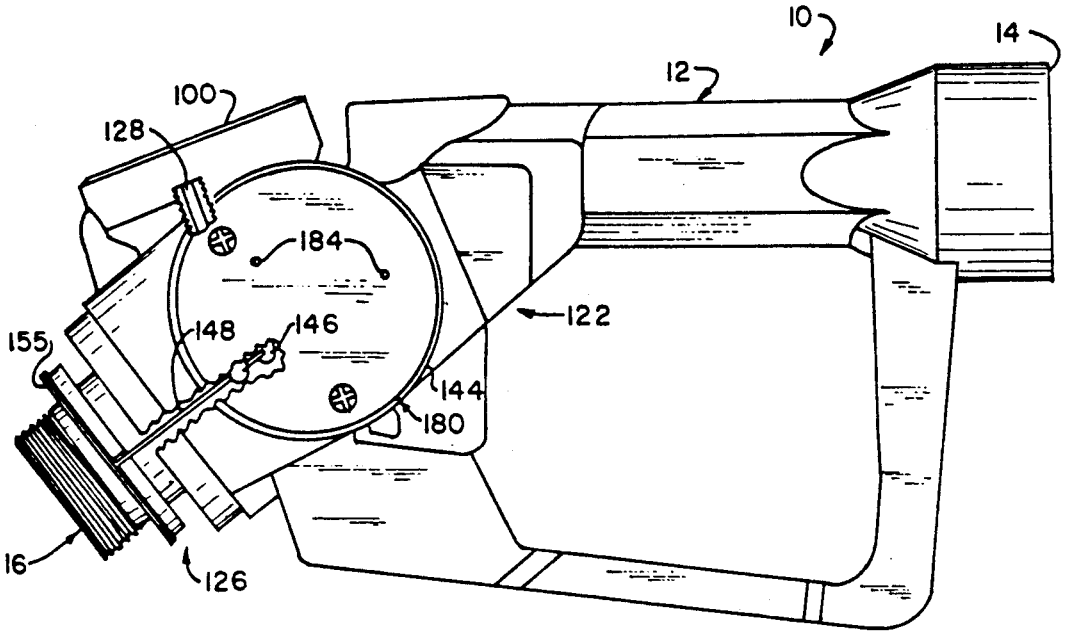
FIG. 2 is an elevational view of the nozzle assembly on the side on which an overpressure assembly of the present invention is installed.
Figure 3:
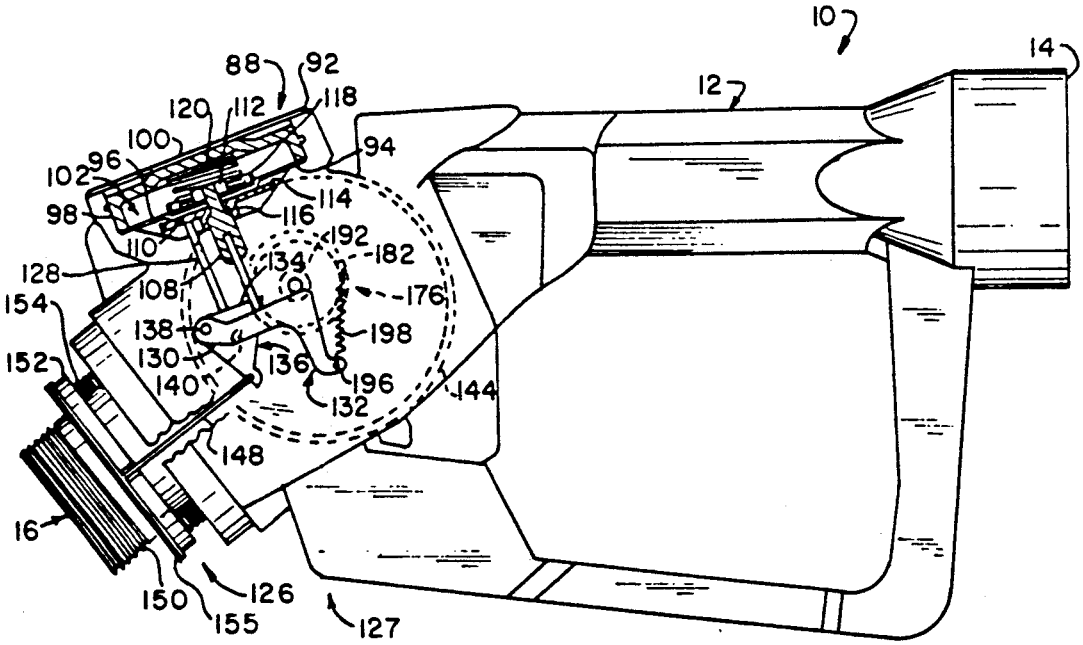
FIG. 3 is a side elevational view similar to FIG. 2, but with the cover plate of the overpressure assembly removed and a portion of the overpressure assembly shown in phantom for clarity purposes.

As shown in FIGS. 1-5, and 7, the improvement first includes means 126 which is responsive to movement of bellows 80 to allow valve 20 to be opened. Referring to FIGS. 2 and 3, a pin 128 is installed in nozzle body 12 and extends generally vertically therewithin. The upper end of the pin bears against the underside of backing plate 114. The other end of the pin rests against one arm 130 of a lever 132. The outer end of arm 130 is pivotally connected to one arm 134 of a second lever 136 by a pivot pin 138. Lever 136, in turn, pivots about a pin 140 which is affixed to a divider 142. The divider is an interior divider located within a housing 144 formed in the side of the nozzle body. Lever 136 has a second arm 146 to which is connected one end of a movable link 148. The outer end of the link is connected to a sleeve 150. As seen in FIG. 1, sleeve 150 is installed over the outside of outlet housing 56. The sleeve has a circumferential lip 152 which forms a seat for one end of a spring 154. The other end of the spring seats against housing shoulder 58. A vapor valve seal 155 fits over the end of the lip facing opening 16 (see FIGS. 1 and 3).

Figure 7:
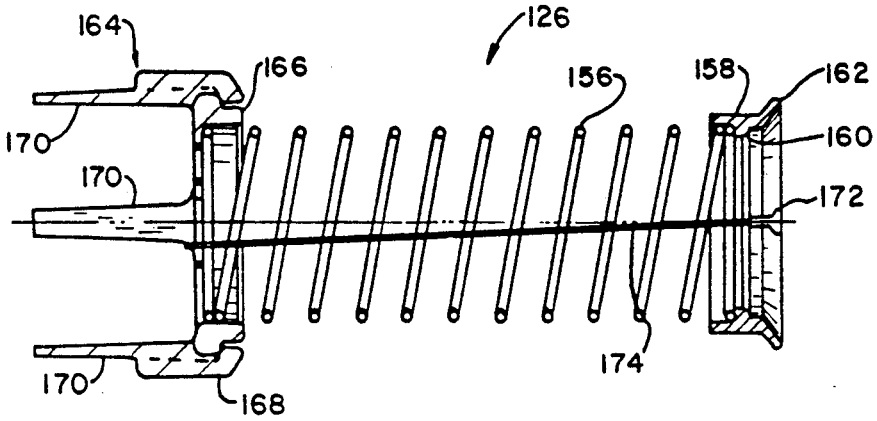
FIG. 7 is a sectional view of a bellows assembly connected to the nozzle; and, FIG. 8 is a sectional view of another portion of the overpressure assembly.

Referring to FIGS. 1 and 7, means 126 includes a spring 156 which is sized to fit around spout 59. One end of this spring is installed in a seat 158 that is a hollow, cup-shaped unit. The seat has an inner flange 160 which is intermediate the length of the seat and provides a seating surface for spring 156. The seat has an outwardly curving, outer flanged surface 162 which slidingly contacts the canted, inner end of adapter 84 for the spring seat to move freely about the inner end of the adapter as the nozzle is moved and the spout is inserted into inlet I. The design of the adapter is such as to facilitate alignment between the between outer end seal 72 and the tank outlet. The other end of spring 156 seats in a vapor valve operator 164. Operator 164 has a hollow, cup-shaped member 166 comprising the seat for spring 156. Member 166, in turn, fits into a ring 168 which fits over the inner end of the spout assembly. The ring has a plurality (4) of rearwardly extending prongs 170 (three such prongs being shown in the sectional view of FIG. 7) the outer ends of which bear against the outer face of sleeve 150. Finally, a retaining cable 174 extends between the ring and seat 158. As seen in FIG. 7, seat 158 has a notch 172 in which an outer, hooked end of the cable fits. The inner end of the cable hooks over the ring 168 at a point between adjacent prongs. Cable 174 holds spring 156 in a slightly compressed position to effectively pre-load the spring. As will be described, this will allow the nozzle to be opened with a minimum amount of spring travel. After opening, the spring will exert a constant pressure on outer seal end 72 to maintain the seal between the inlet and nozzle.

In operation, when the spout of the nozzle assembly is inserted into a tank inlet, outer seal end 72 of the bellows assembly engages the outer face of the inlet tube. As the spout is pushed into the inlet, bellows 80 is compressed, as is spring 156. The spring, acting on operator 164, pushes the operator inwardly. Prongs 170 push against sleeve 150 pushing it inwardly against the force of spring 154. Referring to FIG. 3, as the sleeve moves inwardly, link 148 is moved to the right, as viewed in the FIG. This movement pivots lever 136 counter-clockwise about pin 140. Movement of lever 136 also causes counter-clockwise movement of lever 132. As lever arm 130 of lever 132 moves counter-clockwise, pin 128, which rests on this lever arm falls away from backing plate 114. Diaphragm assembly 88 is now moved, by the force of spring 120, to the position where operation of lever 34 will open valve 20 and fuel will flow through the nozzle. When the spout is withdrawn from the tank inlet, spring 154 pushes sleeve 150 outwardly. Movement of the sleeve pulls link 148 to the left, as seen in FIG. 3, and the link pulls lever 136 in a clockwise direction back to its initial position. Lever 136 moves lever 130, as previously discussed, also back to its initial position. Pin 128 is pushed upwardly and the upper end of the pin pushes against backing plate 114 to move the diaphragm assembly 88 upwardly against the force of spring 120. As the diaphragm assembly moves upwardly, spring **124*a* pushes plunger 38 upwardly. Now, spring 22 reseats valve 20 to shut-off further fuel flow through the nozzle. Consequently, valve can be opened, and fuel can be dispensed through the nozzle, only when the spout is inserted in a tank inlet and not at other times. It will be understood that when bellows 80** is compressed by insertion of the spout into the tank, the vapor valve is open, but when the bellows is relaxed, as when the spout is removed, the vapor valve is closed.

While the above is important to prevent inadvertent operation of the nozzle and a possible fuel spillage, it is also important to terminate fuel flow through the nozzle when the internal pressure within the tank becomes great enough to indicate that the vapor return path is restricted. Otherwise, the internal pressure of the tank would exceed allowable standards. The improvement of the present invention therefore further includes means 176 which is responsive to fuel vapor pressure within the tank to effect valve 20 closing when the pressure indicates the vapor return hose is restricted.

Figure 4:
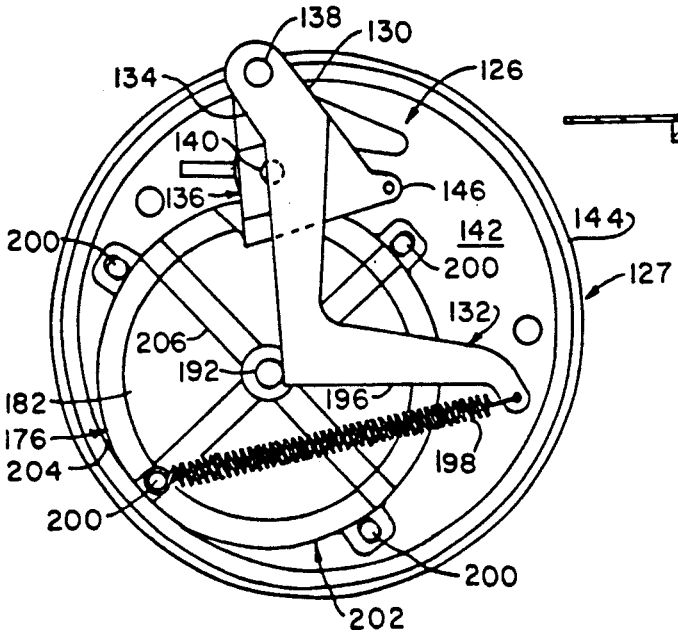
FIG. 4 is a plan view of a portion of the overpressure assembly.

Referring to FIGS. 2-5, means 176 includes a circular diaphragm 178. The outer peripheral margin of the diaphragm is captured between the mating faces of a cover plate 180 and a cup-shaped diaphragm hold-down 182. Cover plate 180, which fits over the open, outer end of housing 144, has at least one vent hole 184 to expose one side of the diaphragm to atmospheric pressure. The other side of the diaphragm, together with the inner wall of the hold-down, defines a pressure chamber 185 which is exposed to the pressure level within the fuel tank. A backing plate 186 for the diaphragm is located on the atmospheric pressure side thereof. Plate 180 has a central bore 188 formed on its inner face and a spring 190 is seated in the bore. The spring bears against backing plate 186 to urge the diaphragm inwardly. Backing plate 186 has a central post 192 extending through a central opening 194 in the diaphragm, through chamber 185, and through the end wall of the hold-down. As seen in FIGS. 3 and 4, arm 130 of lever 132 bears against the end portion of the post protruding through the hold-down. In addition to arm 130, lever 132 has a lever arm 196 which extends at a right angle to arm 130 at the end of arm 130 opposite pivot pin 138. The outer end of lever arm 196 is connected to one end of a spring 198. The other end of this spring is connected to a post 200. The post is one of four such posts which attach a frame 202 to divider 142 within housing 144. The frame has both a circular section 204 and spider section 206 which conforms to the curved inner face of the hold-down. The post 200 to which spring 198 is connected is the post on the opposite side of the housing from the outer end of lever arm 196. The spring thus exerts a pulling force on lever 132 urging lever arm 130 against the post.

When the nozzle is inserted in inlet I, and fuel is being dispensed through the nozzle, the valve 20 is held open in the manner above described. During the filling of the tank, the pressure exerted by spring 190 on diaphragm 178 maintains post 192 in its extended position with lever arm 130 of lever 132 bearing against the post. As the vapor return hose becomes more greatly restricted, the vapor pressure within the tank is communicated to chamber 185 and exerted on the diaphragm. When the pressure gets high enough, for example, when the pressure is approximately 10" of a water column, the diaphragm will move against the force of spring 190. This movement pulls post 192 inwardly into the hold-down and out of contact with lever arm 130. When this happens, spring 198 rotates lever 132 counter-clockwise (as seen in FIG. 3) about pivot pin 138. Pin 128 is pushed upwardly and the upper end of the pin pushes against backing plate 114. This moves diaphragm assembly 88 upwardly against the force of spring 120. Upward movement of the diaphragm assembly allows plunger 38 to move downwardly. Now, spring 22 reseats valve 20 to shut-off further fuel flow through the nozzle.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. In a nozzle for dispensing fuel from a fuel source into a container such as a fuel tank, the nozzle having a body in which is formed a passage for fuel flow through the body, a spout attachable to the body in fluid communication therewith for fuel flow from the body, through the spout, into the tank, a valve interposed in the passage controlling fuel flow through the body, a bellows fitting over the spout and sealingly engaging the inlet of the container when the spout is inserted thereinto to prevent fuel vapors from escaping into the atmosphere, and a vapor return path for fuel vapors to be returned to the fuel source, the improvement comprising means controlling operation of the valve to control fuel flow through the nozzle and including means responsive to effect bellows movement when the spout is inserted into the container to open the valve and to effect bellows movement when the spout is withdrawn to close the valve, means responsive to a vapor pressure change within the vapor return path to effect valve closing when the pressure level indicates the return path is substantially restricted thereby preventing fuel vapors from escaping into the atmosphere, the opening and closing of the valve is effected by a shaft connected to a movable plate, the plate being constrained by a movable pin prior to insertion of the spout into the container, the bellows responsive means including means for moving the pin away from the plate, as the bellows moves, to free the plate for movement allowing the valve to open, one end of the pin bears against the plate and the bellows responsive means includes a lever having a lever arm bearing against the other end thereof, movement of the lever in one direction moving the pin against the plate constraining its movement, and movement of the lever in the opposite direction moving the pin away from the plate and freeing the valve to open, the bellows responsive means includes a spring loaded sleeve installed over the nozzle outlet and movable in response to movement of the bellows, and a link interconnecting the lever and sleeve for movement of the sleeve to produce a corresponding movement of the lever in the direction freeing the pin for movement, a second lever to which one end of the link is connected for movement of the sleeve to move said second lever, said link is connected to one arm of said second lever, and the first said lever is pivotally connected to a second arm thereof whereby movement of the link rotates said second lever about its pivot causing rotation of the first said lever.

2. The improvement of claim 1, wherein said pressure responsive means includes means defining a vacuum chamber and a flexible diaphragm positioned across the chamber to form one side thereof.

3. The improvement of claim 2 further including a post attached to the diaphragm and movable therewith.

4. The improvement of claim 3, wherein said post contacts said first said lever intermediate its length for said first said lever to bear against the post.

5. The improvement of claim 4 further including an air passage by which one side of the diaphragm is exposed to the vapor pressure within the chamber for the pressure to cause movement of the diaphragm, and bias means acting on the diaphragm to bias the diaphragm against such movement, the diaphragm moving when the force exerted thereon by the vapor pressure exceeds that exerted thereon by the bias means, and the post moving with the diaphragm.

6. The improvement of claim 5 further including a spring attached to the end of said first lever opposite the end to which it is connected to said second lever, whereby movement of the diaphragm moves the post out of contact with the first said lever and the first said lever moves, under the force of the spring, in the direction moving the pin back into contact with the plate to move the plate, movement of the plate and effect closure of the valve.

7. In a nozzle for dispensing fuel into a tank comprising a body in which is formed a fuel passage, a spout attachable to the body in fluid communication therewith for fuel to flow from the body through the spout and into the tank, a valve interposed in the passage for controlling fuel flow through the body, a flexible bellows fitting over the spout with the outer end thereof sealingly engaging an inlet of the tank to prevent fuel vapors from escaping into the atmosphere, means controlling operation of the valve to control fuel flow through the nozzle and responsive to movement of the bellows when the spout is inserted into the tank to open the valve and to removal of the spout from the tank to close the valve, and means responsive to the vapor pressure within the tank to effect closing of the valve when an over pressure condition occurs thereby to prevent vapors from escaping, said pressure responsive means including first and second pivotally connected levers one of which moves in response to movement of the bellows and the other of which moves in response to the vapor pressure reaching a predetermined level indicative of the vapor return path being substantially restricted to close the valve and prevent fuel spillage, said valve opening and closing is effected by movement of a shaft connected to a movable plate, the plate being constrained by a movable pin one end of which bears against the plate prior to insertion of the spout into the container, one of said levers having a lever arm bearing against the outer end of the pin whereby movement of said lever in one direction urges the pin against the plate constraining its movement, and movement of the lever in the opposite direction causing movement of the pin away from the plate so it is free to move and the valve can open.

8. The improvement of claim 7 further including a spring loaded sleeve movable with the bellows and interconnected with said lever for movement of the sleeve to produce movement of the lever in the direction freeing the pin for movement.

9. The improvement of claim 8 further wherein said second lever is connected to the sleeve and movement thereof produces rotation of the first lever.

10. The improvement of claim 9, wherein said pressure responsive means includes means defining a vacuum chamber and a flexible diaphragm positioned across the chamber forming one side thereof.

11. The improvement of claim 10 further including a post attached to the diaphragm and movable therewith, the post being positioned intermediate the length of the first said lever which bears thereagainst.

12. The improvement of claim 11 further including an air passage by which one side of the diaphragm is exposed to the vapor pressure within the chamber to cause movement of the diaphragm, and bias means acting on the diaphragm to bias it against such movement, the diaphragm moving when the force exerted thereon by the vapor pressure exceeds that exerted by the bias means.

13. The improvement of claim 12 wherein movement of the diaphragm moves the post out of contact with the first said lever and the control means further includes a spring attached to the first said lever whereby movement of said post allows the spring to move the first said lever, said movement moving the pin back into contact with the plate to effect closure of the valve.

* * * * *